US011028631B2

(12) United States Patent
Courrian et al.

(10) Patent No.: US 11,028,631 B2
(45) Date of Patent: Jun. 8, 2021

(54) VEHICLE DOOR DISPLACEMENT DEVICE

(71) Applicant: FAIVELEY TRANSPORT TOURS, Saint-Pierre-des-Corps (FR)

(72) Inventors: Cédric Courrian, Nazelles-Negron (FR); David Cherubin-Grillo, Saint Avertin (FR); Eric L'Heritier, Ballan Mire (FR); Laurent Huet, Saint-Genouph (FR)

(73) Assignee: FAIVELEY TRANSPORT TOURS, Saint-Pierre-des-Corps (FR)

( * ) Notice: Subject to any disclaimer, the term of this patent is extended or adjusted under 35 U.S.C. 154(b) by 269 days.

(21) Appl. No.: 16/202,356

(22) Filed: Nov. 28, 2018

(65) Prior Publication Data

US 2019/0169913 A1 Jun. 6, 2019

(30) Foreign Application Priority Data

Dec. 6, 2017 (FR) ..... 1761705

(51) Int. Cl.
*E05F 15/655* (2015.01)
*E05F 15/40* (2015.01)
(Continued)

(52) U.S. Cl.
CPC ..... *E05F 15/655* (2015.01); *E05F 15/40* (2015.01); *E05F 15/632* (2015.01); *E05F 15/652* (2015.01); *E05F 15/657* (2015.01); *E05Y 2201/214* (2013.01); *E05Y 2201/22* (2013.01); *E05Y 2201/232* (2013.01); *E05Y 2201/426* (2013.01); *E05Y 2201/474* (2013.01); *E05Y 2800/11* (2013.01); *E05Y 2800/25* (2013.01); *E05Y 2800/41* (2013.01);
(Continued)

(58) Field of Classification Search
CPC ..... E05F 11/54; E05F 11/40; E05F 15/652; E05F 15/655; E05Y 2201/70
USPC ..... 49/362
See application file for complete search history.

(56) References Cited

U.S. PATENT DOCUMENTS 3,745,705 A * 7/1973 Reddy ..... E05F 15/657 49/139
4,198,786 A * 4/1980 Monot ..... B61D 19/02 49/362
(Continued)

FOREIGN PATENT DOCUMENTS

WO 2017/064140 A1 4/2017

*Primary Examiner* — Marcus Menezes
(74) *Attorney, Agent, or Firm* — Christopher R. Carroll; The Small Patent Law Group LLC

(57) ABSTRACT

The device comprises a main body, a fixing member affording fixing of a door leaf to the main body, a ball socket able to drive the main body under the effect of a motor, a roller able to move between (a) an active locking position in which the roller locks the ball socket with respect to the main body, in a closed position of the door leaf and (b) an inactive unlocking position in which a the roller allows displacement of the ball socket with respect to the main body. The device also includes a sleeve that allows a small movement of the fixing member with respect to the ball socket in a displacement direction from the closed position of the door leaf. The device further comprises a tooth that inhibits sleeve to immobilize the fixing member with respect to the ball socket, at least in translation in the displacement direction, when the roller is in the inactive position.

12 Claims, 5 Drawing Sheets

(51) Int. Cl.
*E05F 15/652* (2015.01)
*E05F 15/632* (2015.01)
*E05F 15/657* (2015.01)

(52) U.S. Cl.
CPC ..... *E05Y 2900/506* (2013.01); *E05Y 2900/51* (2013.01); *E05Y 2900/531* (2013.01)

(56) References Cited

U.S. PATENT DOCUMENTS

| | | | | | |
|---|---|---|---|---|---|
| 5,077,938 | A * | 1/1992 | Moreuil | E05F 15/652 | 49/362 |
| 6,094,867 | A * | 8/2000 | Reddy | B61D 19/02 | 49/280 |
| 6,282,970 | B1 * | 9/2001 | Oakley | E05F 15/652 | 74/89.14 |
| 8,661,732 | B2 * | 3/2014 | Kong | E05B 83/363 | 49/118 |
| 10,041,287 | B2 * | 8/2018 | Lessard | E05F 15/40 | |
| 2018/0291670 | A1 * | 10/2018 | Pellegrini | E05F 15/622 | |

* cited by examiner

VEHICLE DOOR DISPLACEMENT DEVICE

TECHNICAL FIELD OF THE INVENTION

The present invention relates to the field of doors for transport vehicles, in particular of the train, tram, metro, trolley bus or bus type. The invention relates more specifically to a device providing the displacing, with respect to the body of the aforementioned vehicle, of a leaf or leaves forming part of said doors, while conferring a partial opening function on this leaf or these leaves. The invention relates more particularly to a sliding-door leaf, but can also be applied to other types of leaf, in particular those equipping doors of the swing and slide type. The invention relates to doors that can be equipped either with a single leaf or with two leaves.

PRIOR ART

Conventionally, a door leaf is movable, in a usually horizontal movement direction, with respect to the body of the vehicle that it equips. In a first position, referred to as closed, this leaf closes off an opening provided in the body whereas, in its open position, it leaves access clear to this opening. This leaf is able to be moved by virtue of a displacement device able to cooperate with motor means. The latter are for example formed by an electric motor, in particular of the rotary type, associated with a worm. The displacement device comprises first of all a main body, typically produced in the form of an elongate cylinder, in an internal space of which the aforementioned worm extends. This body comprises a drive means, in particular a mechanical part forming a nut, which is intended to mesh with this worm.

This displacement device may be equipped with a roller that slides along a rail, in order to provide among other things the locking of the device with respect to the vehicle body. Typically, in the closed position of the leaf, this roller pivots with respect to the principal axis of the body so as to fit in a corresponding housing. In this configuration, the leaf can no longer be displaced with respect to the body, except by taking this roller out of its housing.

When the leaf is closed, it may happen that objects, or even persons, are trapped between this leaf and an adjacent leaf, or between this leaf and the body of the vehicle. In order to be able to release these objects or persons, it is in theory necessary to carry out a complete opening maneuver of the leaf. In other words, it is necessary first of all to release the roller, and then to move the leaf under the effect of the motor means.

This involves a relatively lengthy action time, which is detrimental with regard to correct service of the transport vehicle. Moreover, any trapped object is liable to be damaged. Furthermore, should a person be momentarily immobilized, this waiting time may prove to give rise to anxiety, or even be detrimental to their physical integrity.

In order to remedy this drawback, it is proposed to equip the device for displacing the leaf with means providing auxiliary opening thereof, also referred to as partial safety opening. For this purpose, this device is provided with an attached arm, offset with respect to the main body. A means for fixing the leaf is mounted slidably on this arm, counter to a compression spring. Under these circumstances, a passenger can himself manually push the leaf in a small movement, namely a predefined travel of around 50 to 150 millimeters. The small amplitude of this movement prevents any risk of a passenger falling out of the vehicle. This action can therefore be carried out quickly, without having to release the roller or actuate the motor means.

Although they allow immediate action, these partial opening means do however have specific drawbacks. This is because it has been found that a device for displacing a leaf, provided with such partial opening means, causes parasitic movements at this leaf when it is opened or closed. Moreover, use of this displacement device limits the possible acceleration of the leaves, while interfering with the control of the door.

Having regard to the above, one objective of the present invention is to at least partially remedy the drawbacks of the prior art mentioned above.

Another objective of the invention is to propose a device for moving a leaf, the use of which does not substantially cause any parasitic movement at the leaf, while providing a reliable partial opening function.

Another objective of the invention is to propose such a displacement device, the mechanical structure of which is relatively simple.

OBJECTS OF THE INVENTION

According to the invention, at least one of the above objectives is achieved by means of a device (I) for displacing a door leaf (100) with respect to a transport vehicle body, in particular of the train, tram, metro, trolley bus or bus type, said leaf being movable in a displacement movement (A1) between a closed position and an open position, with reference to an opening (104) provided in the body, this device comprising:

a main body (1), fixing means (8) for fixing the leaf on the body, drive means (30), able to drive the body under the effect of motor means (106, 108), locking means (36), able to move between an active locking position in which they lock the drive means with respect to the body, in the closed position of the leaf, and an inactive release position, in which they allow displacement of the drive means with respect to this body, partial opening means (7), able to allow a small movement of the fixing means with respect to the drive means, in the movement direction, from the closed position of the leaf, characterized in that this device further comprises means (52) for inhibiting the partial opening means (7), able to immobilize the fixing means (8) with respect to the drive means (30), at least in translation in said displacement movement (A1), when the locking means (36) are in their inactive position.

It should be noted first of all that it is to the credit of the Applicant that they have understood the origin of these drawbacks, related to the use of the known partial opening means, as described above. In substance, the Applicant has identified that the spring used in the prior art can be compressed by a small force, in order to offer relatively low mechanical resistance. In this way, most passengers are physically able to carry out this partial opening operation. This low compressive strength of the spring does however result in the latter having a tendency to compress in an unwanted fashion, during the acceleration caused by the automatic closing or opening of the leaf.

In this regard, the invention makes it possible to remedy these drawbacks, while keeping the same functionalities as in the prior art.

In accordance with the invention, as long as the displacement device is not locked, the partial opening function is inhibited. Moreover, this prevents any substantial parasitic movement of the leaf and, moreover, this allows control of the door with greater acceleration and deceleration than in the prior art. Under these circumstances, the duration of automatic opening and closing of the leaf is thereby reduced, which makes the overall service of the vehicle more fluid.

On the other hand, as soon as the displacement device reaches its locked position, this partial opening function is activated. Consequently a passenger can manually push the leaf, in a similar manner to what is provided for in the prior art.

According to other features of the invention:

- the inhibition means (52) are able to move between respectively active and inactive positions, these inhibition means being able to pass from their active position to their inactive position under the effect of the passage of the locking means (36) from their inactive position to their active position;
- the inhibition means (52) are able to pass from their inactive position to their active position under the effect of the passage of the locking means (36) from their active position to their inactive position;
- the locking means (36) are secured to the inhibition means (52), at least in rotation about said displacement movement;
- the locking means (36) and the inhibition means (52) are carried by a socket (2), mounted on the main body;
- said socket (2) is constrained to move with the body (1) in translation, in said displacement movement, this socket (2) furthermore being constrained to rotate with respect to this body about said displacement movement;
- the locking means comprise at least one roller (36), carried by an arm extending radially from said body (1);
- the inhibition means comprise a ring (50) mounted coaxially with respect to the body, and an inhibition tooth (52) projecting radially with respect to said ring;
- the fixing means (8) define a recess (88) for the selective reception of the inhibition tooth (52);
- in the inhibition position, the inhibition tooth (52) is able to come into abutment against the walls of the recess (88), in the displacement direction;
- the partial opening means comprise a sleeve (7), mounted coaxially with respect to the main body (1), this sleeve being constrained to move at least in translation with the fixing means (8) in said displacement movement;
- the sleeve (7) is able to move on the principal axis of the body, with respect to the drive means (30), counter to an elastic return means (56);
- the elastic return means comprises a compression spring (56), a first end (56') of which bears against a stop cover (5), mounted on the main body, and a second end (56") of which bears against the sleeve (7).

These additional features can be implemented with the aforementioned main object, individually or in any technically compatible combinations.

Another subject matter of the invention is a door for a transport vehicle, in particular of the train, tram, metro, bus or trolley bus type, comprising a fixed frame secured to the frame of said vehicle, at least one leaf, and at least one displacement device, allowing the displacement of said leaf with respect to said fixed frame, the or each displacement device being as above.

Another subject matter of the invention is a transport vehicle, in particular of the train, tram, metro, bus or trolley bus type, comprising at least one door as above.

DESCRIPTION OF THE FIGURES

The invention will be described below with reference to the accompanying drawings, given solely by way of non-limitative examples, in which.

Figure 1:
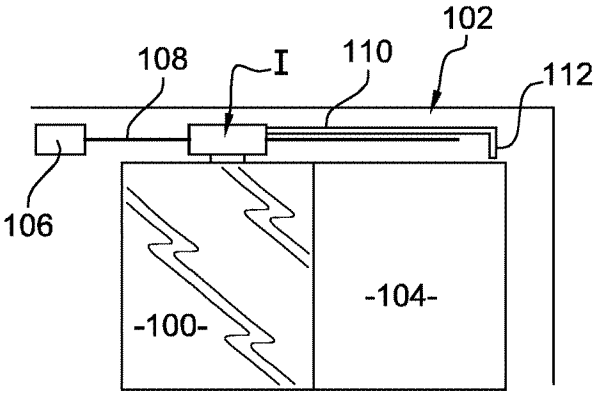
FIGS. 1 and 2 are schematic front views, illustrating in particular the open and closed positions of a leaf equipped with a displacement device according to the invention.

The following numerical references are used in the present description:

| | | | |
|---|---|---|---|
| 100 | Leaf | I | Displacement device |
| 102 | Fixed frame | 104 | Opening |
| 106 | Electric motor | 108 | Worm |
| 110 | Rail | 112 | Housing of 110 |
| 1 | Body of I | A1 | Axis of 1 |
| 10 | Collar of 1 | | |
| 2 | Socket | 22 | Shoulder of 2 |
| 3 | Neck | 30 | Ball socket |
| 36 | Roller | 34 | Arm |
| 4 | Barrel | 40 | Annulus |
| 42 | Arm | 44 | Roller |
| 45 | Protrusion | 46 | Spring tab |
| 50 | Ring | 52 | Tooth of 50 |
| 54 | Nut | | |
| 6 | Cover | 60 | Bottom of 6 |
| 62 | Orifice of 60 | 64 | Rim |
| 66 | Internal face of 60 | 68 | Stop buffer |
| 56 | Spring | 56', 56" | Ends of 56 |
| 7 | Sleeve | 70 | Face of 7 |
| 72 | Shoulder of 7 | 76 | Ball joint |
| 8 | Fixing member | 80 | Hoop |
| 82 | Flange | 84 | Orifice |
| 86 | Lug | 88 | Recess of 86 |
| F36 | Sliding of 36 | F8 | Locking of 8 with respect to translation |
| f36 | Rotation of 36 | F100 | Translation of 100 |
| f52 | Rotation of 52 | | |

DETAILED DESCRIPTION

The accompanying figures illustrate a leaf designated overall by the reference 100, which forms the opening leaf of a door equipping a transport vehicle. This door also comprises a fixed frame 102 of a conventional type, shown schematically in FIGS. 1 and 2, which is disposed at the periphery of an opening 104 provided in the body of this vehicle. This door may be provided with a single leaf as in FIGS. 1 and 2, or at least two such leaves. In the example illustrated, the leaf 100 equips for example a train, a metro, a tram, a trolley bus or a bus. Hereinafter, it is assumed that the leaf 100 is vertical and that the terms "interior" and "exterior" are used with reference to the body of this transport vehicle.

One subject matter of the invention is more particularly a device, designated overall by the reference I, which allows the displacement of the leaf 100. This device, which is illustrated schematically in FIGS. 1 and 2, cooperates with motor means of a type known per se. In the example illustrated, these motor means comprise a rotary electric motor 106, which actuates a worm 108. This worm 108 cooperates with an element of the device I, forming a nut, described with reference to FIGS. 3 and 4.

Figure 2:
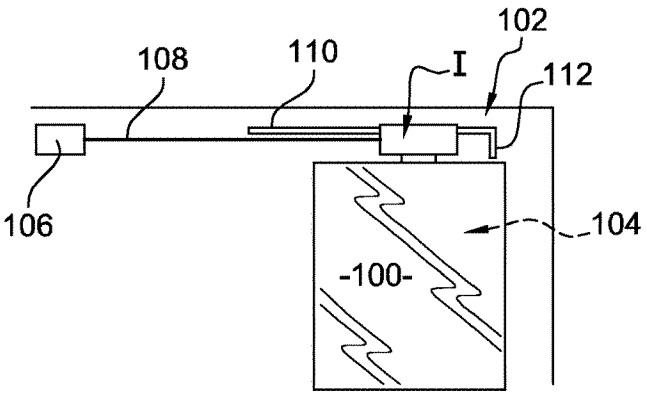

This allows the movement of this device I and consequently the displacement of the leaf 100 secured thereto, in a so-called displacement movement, which corresponds to a sliding in a horizontal displacement direction in the example illustrated. FIGS. 1 and 2 show the respective open and closed positions of the leaf, in which the latter respectively leaves clear and closes off the opening 104. During its displacement, as will be seen in more detail hereinafter, the device I cooperates with a rail 110, extending immediately above the opening 104. At its end adjacent to the opening 104, this rail 110 is extended by a so-called locking housing 112, extending substantially perpendicular to the principal direction of this rail. This housing and the locking function that it provides will be described in more detail with reference in particular to FIGS. 7 to 9.

Figure 3:
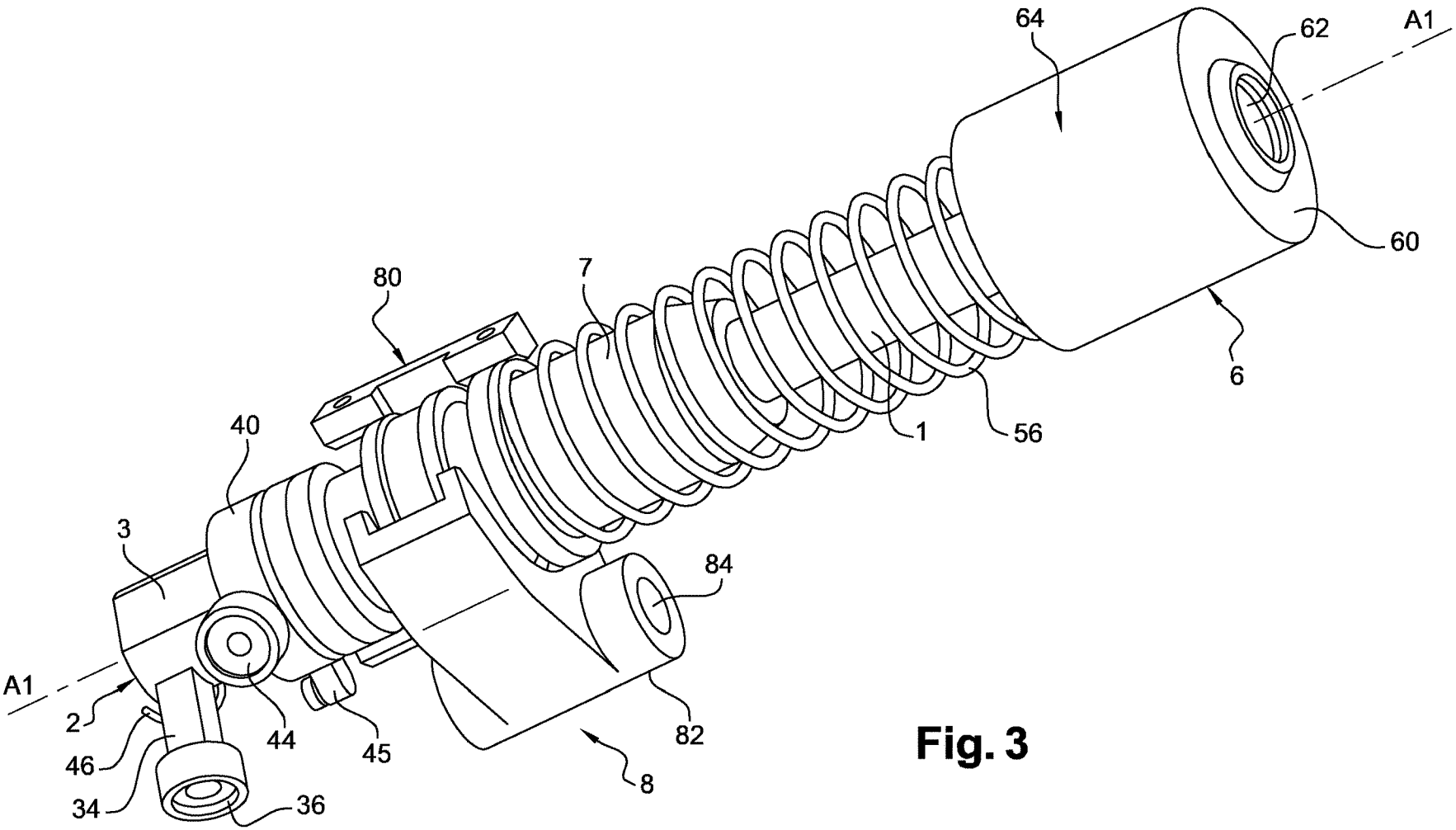
FIGS. 3 and 4 are perspective views, at two different angles, illustrating more precisely the device according to the invention.
Figure 4:
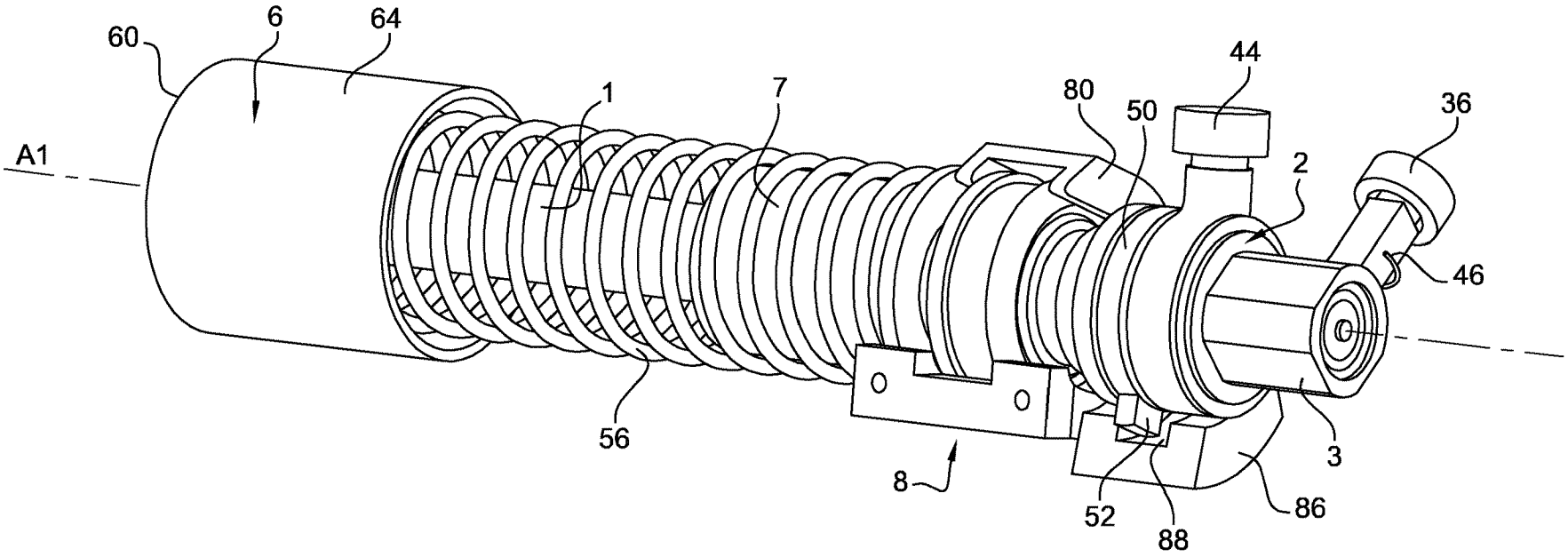
Figure 5:
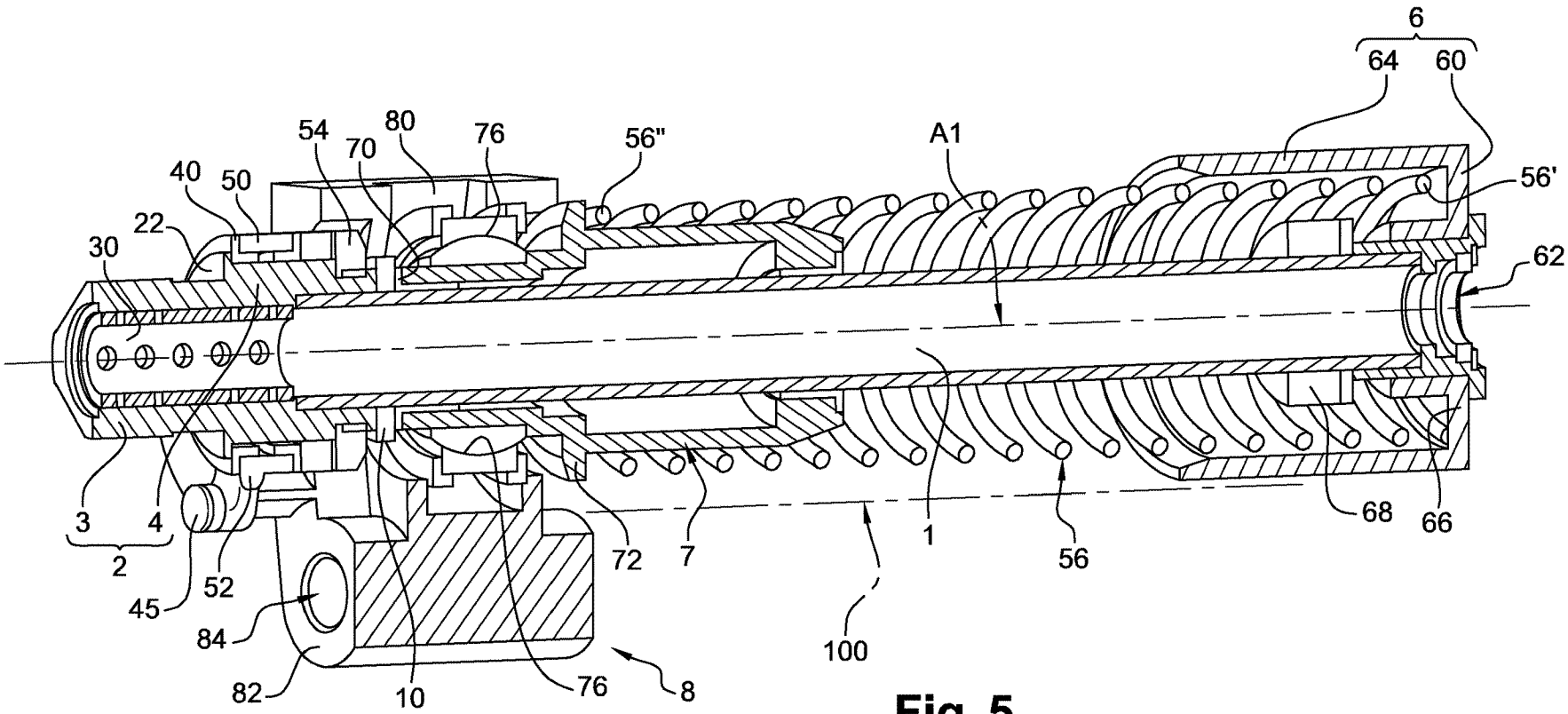
FIG. 5 is a perspective view with longitudinal section, illustrating this displacement device.

With reference now to FIGS. 3 to 5, the displacement device I according to the invention comprises first of all a main body, designated overall by the reference 1. This body, elongate in shape, is in the form of a hollow cylinder, the principal axis of which is denoted A1. This axis also defines the principal direction of displacement of the leaf 100, between its two extreme positions in FIGS. 1 and 2. The body 1 is, in the vicinity of one of its ends, provided with a stop collar 10.

The device further comprises a socket 2, fixed against the collar 10 of the body 1 by a suitable means, in particular by screwing. This socket 2 is therefore constrained to both translate and rotate with the body 1. The socket comprises an end neck 3, opposite to the body 1, and a proximal barrel 4, separated by a shoulder 22 of the socket.

The neck 3 receives a ball socket 30, forming a nut, visible in particular on the cross-section in FIG. 5. This socket 30 is fixed against the internal face of this neck by any suitable means, in particular by screwing. This nut is able to cooperate, in a manner known per se, with the worm 108 in FIGS. 1 and 2. This neck is moreover provided with a radial arm 34, terminating in a roller 36. As will be seen in more detail hereinafter, this roller 36, which is guided along the rail 110, provides locking with respect to the fixed frame.

The barrel 4 comprises first of all an annulus 40, adjacent to the shoulder 22. This annulus 40 is equipped with an arm 42, terminating in a supplementary roller 44. Unlike the roller 36, this roller 44 is forced to slide in the rail 110, so that it cannot pivot about the axis A1, just like the ring 40 that carries it. This ring 40 is further provided with a protrusion 45, projecting radially outwards. This protrusion forms a stop for the first end of a torsion spring 46, the main winding of which is disposed around the socket and the second end of which surrounds the arm 34. In the figures, only this second end is illustrated, whereas the first end and the winding are not shown. This spring is prestressed, so as to pivot the arm 34 and its roller 36 towards the bottom of the housing 112.

The barrel 4 further comprises a ring 50, extended by a so-called inhibition tooth 52, which constitutes an essential element of the invention. This ring is constrained at least to rotate with the socket 2 and the pivoting arm 34 carrying the roller 36. Finally, a nut 54 is screwed onto the barrel 4, opposite to the neck 3, in order to guarantee firm securing of the annulus 40 and ring 50 on this barrel.

At its end opposite to the socket 2, the body 1 is associated with a cover 6, which comprises first of all a bottom 60, in which there is hollowed out an orifice 62 allowing the worm to pass. This bottom is extended, in the direction of the socket 2, by a rim 64. This cover provides the compression and the guidance of a helical spring 56, of a type known per se. For this purpose, a first end 56' of this spring 56 bears against the internal face 66 of the bottom 60. A buffer 68, advantageously produced from a slightly damping material, such as an elastomer material, is secured to the periphery of the body 1. The function of this buffer, which is placed in the vicinity of the bottom 60 of the cover, will be explained hereinafter.

The various mechanical elements 2 to 68 described above are constrained at least to translate with the body in the principal direction A1. Other mechanical elements, which have at least one degree of freedom in translation with respect to this body, in this principal direction, will now be described.

A hollow sleeve 7 is first of all mounted on the body 1, being coaxial with the latter. This sleeve has a first front face 70, turned towards the socket 2, which bears against the collar 10. This sleeve is also provided with a shoulder 72 against which the second end of the helical spring 56 bears. This sleeve 7 cooperates with a so-called fixing member, designated overall by the reference 8, which provides a function of fixing the leaf 100.

The sleeve 7 and the fixing member 8 are mutually constrained to move in translation, in particular along the principal axis A1. On the other hand, they have at least one mutual degree of freedom with respect to rotation, in particular about this axis A1. For this purpose, a ball joint 76 is interposed between this sleeve and this fixing member 8. In the example illustrated, the convex part of this ball joint is secured to the sleeve, between the shoulder 72 and the front face 70, while the concave part of this ball joint is secured to a hoop 80, belonging to this fixing member 8.

This hoop 80 is extended, radially outwards, by a flange 82 providing the fixing proper of the leaf 100. This fixing can be carried out by any suitable known means. In the example illustrated, the flange 82 has in it an orifice 84, intended for the passage of a shaft, not shown, which cooperates with the leaf 100. In FIG. 5, the top part of the leaf 100 is illustrated in dot and dash lines, schematically.

Finally, the fixing member 8 is provided with a lug 86, projecting axially from the flange 82 in the direction of the socket 2. On its internal wall, this lug 86 has in it a recess 88 extending in an arc of a circle, so as to cooperate with the inhibition tooth 52.

A description will now be given, with reference in particular to FIGS. 7 to 9, of the use of the displacement device I presented above. In these FIGS. 7 to 9, the guide rail 110 and its locking housing 112, the rollers 36 and 44, the inhibition tooth 52 and the lug 86 and its recess 88 have in particular been shown.

Figure 7:
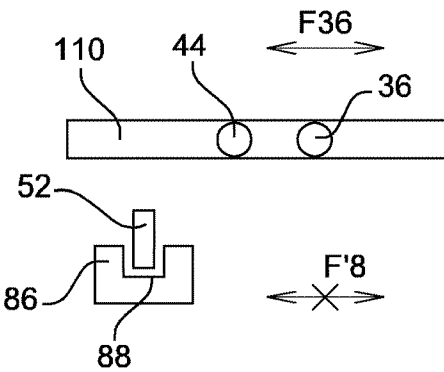
FIGS. 7 to 9 are three schematic front views, illustrating more particularly various positions of a locking roller and inhibition tooth, forming part of this displacement device.

FIG. 7 illustrates the normal displacement of the leaf between its open and closed positions. In this configuration, the rollers 36 and 44 slide along the rail 110, in a translation represented by the double arrow F36. In addition, the tooth 52 is situated between the walls of the recess 88. In other words, this tooth prevents any translation between the fixing member 8 and the body 1, in the principal direction A1, which is represented by the barred double arrow F8. During this displacement, the spring 56 is inactive, so that it does not generate any parasitic movement. As explained above, it is therefore possible to control the leaf with high acceleration and deceleration.

Figure 8:
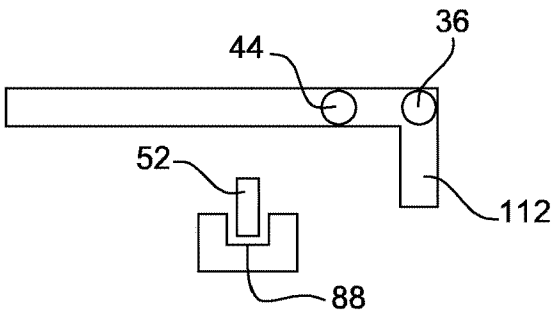

FIG. 8 illustrates the leaf in a position corresponding to the closure of the opening, without this leaf yet being locked. In other words, the roller 36 does not cooperate with the housing 112. Under these conditions, the tooth 52 is still in the internal space of the recess 88, so as to prevent translation between the fixing member 8 and the body 1.

Figure 9:
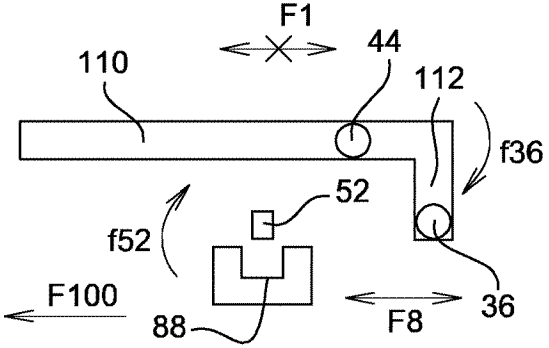
Figure 6:
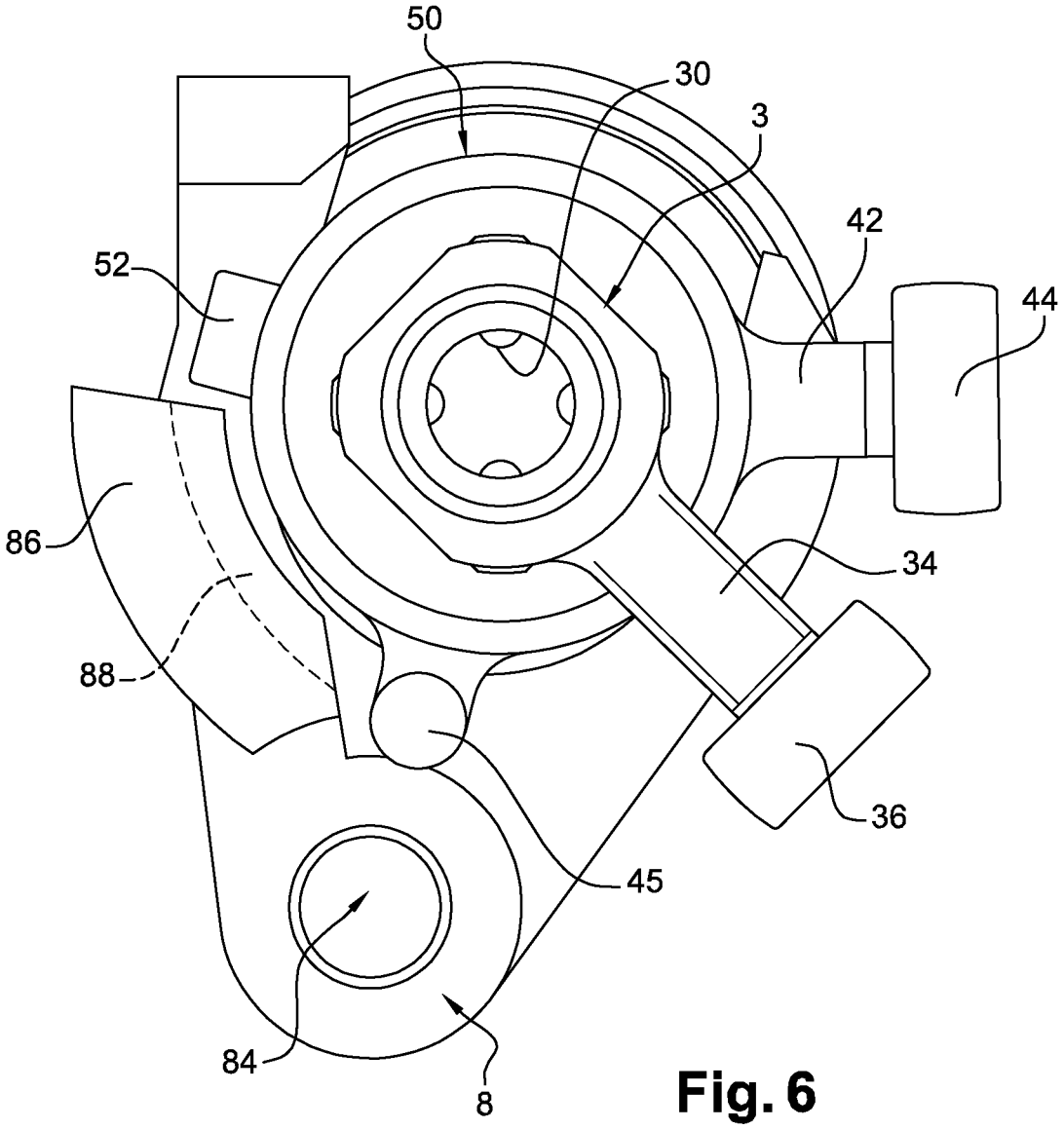
FIG. 6 is an end view illustrating this displacement device.

FIG. 9 illustrates the leaf in its closed and locked position. In other words, the roller 36 is pivoted about the axis A1 from its position in FIG. 6, in the direction of the arrow f36, under the action of the torsion spring 46. It will be recalled that the socket 2, carrying this roller, and the ring 50, carrying the inhibition tooth 52, are mutually fixed together. Consequently the pivoting of the roller causes a corresponding pivoting of the tooth 52 out of the recess 88, which is represented by the arrow f52.

At the end of this pivoting, this tooth is no longer between the walls of the recess. The fixing member 8 therefore now has a degree of freedom in translation with respect to the body 1, along the axis A1, which is represented by the double arrow F8. A user can therefore push the leaf, in the direction of the arrow F100, so as to fulfil the partial opening function, if required. The movement of the leaf takes place counter to the spring 56, the return force of which can be predefined in order to adjust the parameters of this partial opening. Moreover, any translation of the body 1 and consequently of the socket 2 in the principal direction A1 is prevented, which is represented by the barred double arrow F1.

At the end of travel of this movement, the front face of the sleeve 7 comes into abutment against the facing face of the buffer 68. The distance between this sleeve and this buffer, in the idle position of the spring, is determined so that these two mechanical elements come into abutment before the turns of the spring 56 are in mutual contact. Consequently, the controlled abutment of the sleeve does not generate any unwanted audible nuisance.

From the locked position in FIG. 9, if it is wished to open the leaf 100, first of all the roller 36 is released out of the recess 112, by means of a rotation opposite to that of the arrow f36. This rotation may be activated by the motor itself, or by an emergency mechanical element of the release handle type. The tooth 52 then pivots, in the opposite direction to that illustrated by the arrow f52. This roller and this tooth are then in the same positions as those illustrated in FIG. 7. The tooth 52 once again locks the fixing member 8, so that the automatic opening of the leaf can be implemented, without the spring 56 causing a parasitic movement.

It will be noted that, in the perspective views in FIGS. 3 and 4, the roller 36 is in the locked position corresponding to the schematic view in FIG. 9. In the unlocked position in the schematic views 7 and 8, the roller 36 is aligned with the roller 44, on an axis parallel to the principal axis A1.

The invention is not limited to the example described and depicted.

Thus, in the present example, the inhibition tooth 52 is able to move between its two functional positions by virtue of the motorization and drive means, allowing the displacement of the leaf. Such an embodiment is advantageous in terms of overall manufacturing simplicity, since it makes it possible to limit the number of mechanical elements constituting the device of the invention. However, as a variant that is not shown, it is possible to provide specific control means, making it possible to control the inhibition means. By way of non-limitative examples, these additional control means may comprise an electromagnet, an additional motor specifically dedicated or any other similar system.

Moreover, in the present example, the sleeve 7 allowing partial opening of the leaf 100, whereas the door is locked, is mounted coaxially with respect to the main body 1. Such an embodiment is advantageous in terms of global compactness, since it makes it possible to limit the space requirement of the device of the invention, in particular in the radial direction. However, in a variant that is not shown, it is possible to provide other spatial arrangements of the mechanical parts. By way of example, the sleeve may be offset with respect to the body, being in particular mounted on an auxiliary axis, parallel to the aforementioned body but distant therefrom.

Furthermore, in the present example, the displacement movement of the leaf corresponds to a translation thereof, which takes place in a displacement direction. In this case, the leaf equips a so-called sliding door. By way of a variant, this leaf may be subjected to a displacement movement different from a simple translation. In this case this displacement movement comprises, in addition to a translation in a principal displacement direction, a supplementary translation and/or rotation. In this light, this leaf may for example equip a so-called swing and slide door.

The invention claimed is:

1. A displacement device for displacing a door leaf with respect to a vehicle body, the door leaf being movable in a displacement direction between a closed position and an open position with reference to an opening provided in the vehicle body, the displacement device comprising:

a main body;

a fixing member configured to fix the door leaf to the main body;

a ball socket configured to drive the main body under operation of a motor;

a roller configured to move between fa) an active locking position in which the roller locks the ball socket with respect to the main body in a closed position of the door leaf and (b) an inactive release position in which the roller allows displacement of the ball socket with respect to the main body;

a sleeve configured to allow a limited movement of the fixing member with respect to the ball socket in a movement direction from the closed position of the door leaf; and an inhibition device for inhibiting movement of the sleeve and configured to immobilize the fixing member with respect to the drive means ball socket at least in translation in the displacement direction while the roller is in the inactive release position.

2. The displacement device according to claim 1, wherein the inhibition device is configured to move between an active inhibition position and an inactive inhibition position, the inhibition device configured to rotate from the active inhibition position to the inactive inhibition position from movement of the roller from the inactive release position to the active locking position.

3. The displacement device according to claim 2, wherein the inhibition device is configured to rotate from the inactive inhibition position to the active inhibition position from passage of the roller from the active locking position to the inactive release position.

4. The displacement device according to claim 1, wherein the roller is secured to the inhibition device in rotation about the displacement direction.

5. The displacement device according to claim 1, wherein the roller is coupled to the main body by a radially extending arm.

6. The displacement device according to claim 1, wherein the inhibition device includes a ring coaxially mounted with respect to the main body and an inhibition tooth projecting radially from the ring.

7. The displacement device according to claim 6, wherein the fixing member defines a recess positioned to receive the inhibition tooth.

8. The displacement device according to claim 7, wherein, in an inhibition position, the inhibition tooth is in abutment against walls of the recess in the displacement direction.

9. The displacement device according to claim 1, wherein the sleeve is coaxially mounted with respect to the main body the sleeve constrained to move at least in translation with the fixing member in the displacement direction.

10. The displacement device according to claim 9, wherein the sleeve is configured to move on a principal axis of the main body with respect to the ball socket and counter to a spring having a first end that bears against a stop cover mounted on the main body and a second end that bears against the sleeve.

11. A door for a vehicle, the door including a fixed frame secured to a vehicle frame of the vehicle, at least one door leaf, and at least one displacement device configured to move the at least one door leaf in a displacement direction with respect to the fixed frame, the displacement device including:

a main body;

a fixing member configured to fix the at least one door leaf to the main body;

a ball socket configured to drive the main body under operation of a motor;

a roller configured to move between (a) an active locking position in which the roller locks the ball socket with respect to the main body in a closed position of the at least one door leaf and (b) an inactive release position in which the roller allows displacement of the ball socket with respect to the main body;

a sleeve configured to allow a limited movement of the fixing member with respect to the ball socket in a movement direction from the closed position of the at least one door leaf: and an inhibition device for inhibiting movement of the sleeve and configured to immobilize the fixing member with respect to the ball socket at least in translation in the displacement direction while the roller is in the inactive release position.

12. A vehicle comprising at least one door having a fixed frame secured to a vehicle frame of the vehicle, at least one door leaf, and at least one displacement device configured to move the at least one door leaf in a displacement direction with respect to the fixed frame, the displacement device including:

a main body;

a fixing member configured to fix the at least one door leaf to the main body;

a ball socket configured to drive the main body under operation of a motor;

a roller configured to move between (a) an active locking position in which the roller locks the ball socket with respect to the main body in a closed position of the at least one door leaf and (b) an inactive release position in which the roller allows displacement of the ball socket with respect to the main body;

a sleeve configured to allow a limited movement of the fixing member with respect to the ball socket in a movement direction from the closed position of the at least one door leaf: and an inhibition device for inhibiting movement of the sleeve and configured to immobilize the fixing member with respect to the ball socket at least in translation in the displacement direction while the roller is in the inactive release position.

* * * * *